US005551885A

United States Patent [19]

Yamanashi et al.

[11] Patent Number: 5,551,885

[45] Date of Patent: * Sep. 3, 1996

[54] CONNECTOR SYSTEM REQUIRING SMALL FORCE BY USE OF OPERATION LEVER

[75] Inventors: Makoto Yamanashi; Nobuyuki Akeda, both of Haibara-gun, Japan

[73] Assignee: Yazaki Corporation, Tokyo, Japan

[ * ] Notice: The term of this patent shall not extend beyond the expiration date of Pat. No. 5,308,255.

[21] Appl. No.: 226,481

[22] Filed: Apr. 12, 1994

Related U.S. Application Data

[63] Continuation-in-part of Ser. No. 52,767, Apr. 27, 1993.

[30] Foreign Application Priority Data

May 1, 1992 [JP] Japan ..... 4-112579
Apr. 12, 1993 [JP] Japan ..... 5-018279 U

[51] Int. Cl.[6] ..... H01R 13/62
[52] U.S. Cl. ..... 439/157; 439/160; 439/372
[58] Field of Search ..... 439/153–157, 439/160, 372

[56] References Cited

U.S. PATENT DOCUMENTS 5,230,635 7/1993 Takenouchi et al. ..... 439/157
5,257,942 11/1993 Taguchi ..... 439/157
5,308,255 5/1994 Yamanashi ..... 439/157
5,320,544 6/1994 Naoto et al. ..... 439/157

FOREIGN PATENT DOCUMENTS 52133993 10/1993 Japan .
2241841 9/1991 United Kingdom ..... 439/160

*Primary Examiner*—P. Austin Bradley
*Assistant Examiner*—Jill DeMello
*Attorney, Agent, or Firm*—Jacobson, Price, Holman & Stern, PLLC

[57] ABSTRACT

A connector system requiring a small force for connecting a pair of connectors by use of a connecting operation lever in which a female connector is accommodated within an accommodating frame including flexible side walls provided with pivots and a male connector is then connected to the female connector within the frame. The connecting operation lever includes: drive plates having pivot holes engaging with pivots of the frame; introducing tapered portions disposed on ends of the inner surface of the drive plate for introducing the pivots; connection guide grooves for guiding the pivots into the pivot holes; and separation-preventing plates arranged outside the side walls of the frame to engage with the ends of the drive plates. Thus, it is possible to obtain the connector system in which the lever is easily fixed to the connector-accommodating frame and the connection of both components are secured once they are connected to each other.

2 Claims, 5 Drawing Sheets

CONNECTOR SYSTEM REQUIRING SMALL FORCE BY USE OF OPERATION LEVER

The following is a continuation-in part application of Ser. No. 08/052767 filed on 27 Apr. 1993.

BACKGROUND OF THE INVENTION

1. Field of the Invention

The present invention relates to a connector system in which a pair of male and female connectors can be connected to each other by use of an operation lever. More particularly, the invention relates to a connector-accommodating frame with a connecting operation lever provided for use of performing the connecting operation with a small force.

2. Description of the Related Art

The following connector system is known. An operation lever having cam grooves is attached to both sides of a male connector via pivots, and cam pins engaged with the cam grooves of the operation lever are arranged on both sides of a female connector. Further, locking means for locking the movement of the operation lever are provided for the male connector. At the initial connection of the male and female connectors, the cam grooves of the operation lever are engaged with the cam pins and the lever is pressed in the direction in which the connectors are connected so as to be pivoted, thereby advancing the male connector toward the female connector while requiring a small force due to the action of a lever. Thus, the connection of the connectors is completed in the position where the operation lever is engaged with the locking means provided for the male connector.

The connecting operation of the conventional connector system with a lever requiring only a small force as described above presents the following problem. The pins disposed on both sides of the female connector are engaged with the pivot holes provided for the operation lever, in which case, the pins are easily separated from the pivot holes.

SUMMARY OF THE INVENTION

Accordingly, in view of the above problem, an object of the present invention is to provide a connector system requiring only a small force by use of an operation lever in which the attachment of the lever and the connection of connectors are easily achieved and the reliable operation of the lever is employed.

Another object of the invention is to provide a connector system requiring only a small force by use of an operation lever in which a frame provided with a lever is arranged to simplify the attachment of the lever and the connection of the connectors.

In order to achieve the above objects, the present invention provides a connector system requiring only a small force in which a female connector is accommodated within a frame including flexible side walls provided with pivots and is then connected to a male connector by use of a connecting operation lever. The lever includes drive plates having pivot holes engaged with the pivots provided for the frame. Pivot-introducing tapered portions are arranged on the ends of the inner surfaces of the drive planes and connection guide grooves for guiding the pivots into the pivot holes are formed. Separation-preventing plates engaged with the ends of the drive plates are arranged on the outer surfaces of the side walls of the frame.

According to the construction as described above, while the ends of the drive plates are engaged with the separation-preventing plates, the pivot-introducing tapered portions abut against the pivots and, in such a state, the drive plates are pressurized so as to allow the side walls of the frame to be flexibly deformed via the pivots and also allow the connection guide grooves no guide the pivots into the pivots holes, thus fitting the operation lever into the frame.

Other objects and advantages of the invention will appear more fully from the following description of the invention.

DESCRIPTION OF THE PREFERRED EMBODIMENT

Figure 1:
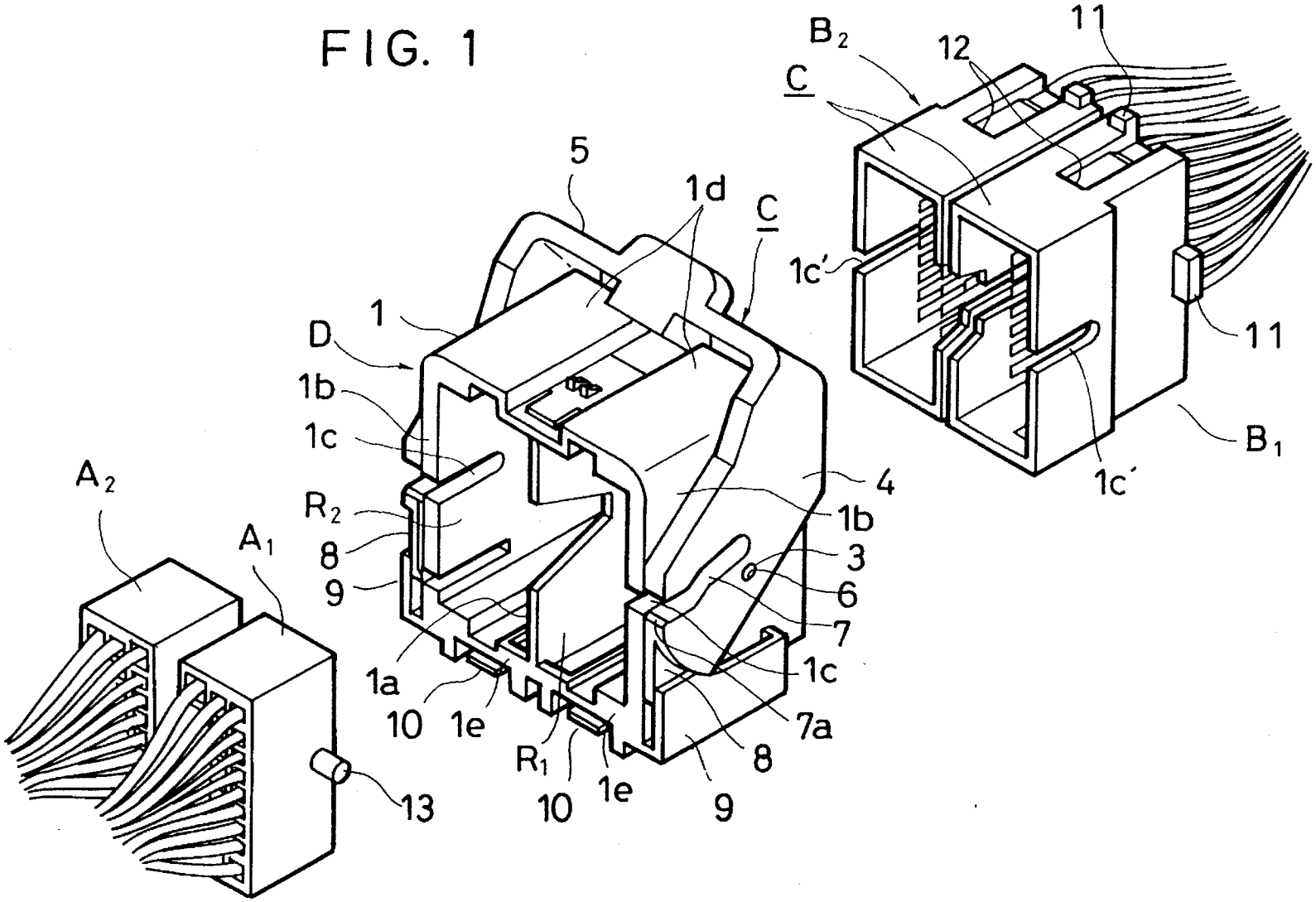
FIG. 1 is an exploded perspective view of a connector system and shows an example of the use of a connector-accommodating frame with a connecting operation lever according to the present invention.
Figure 2:
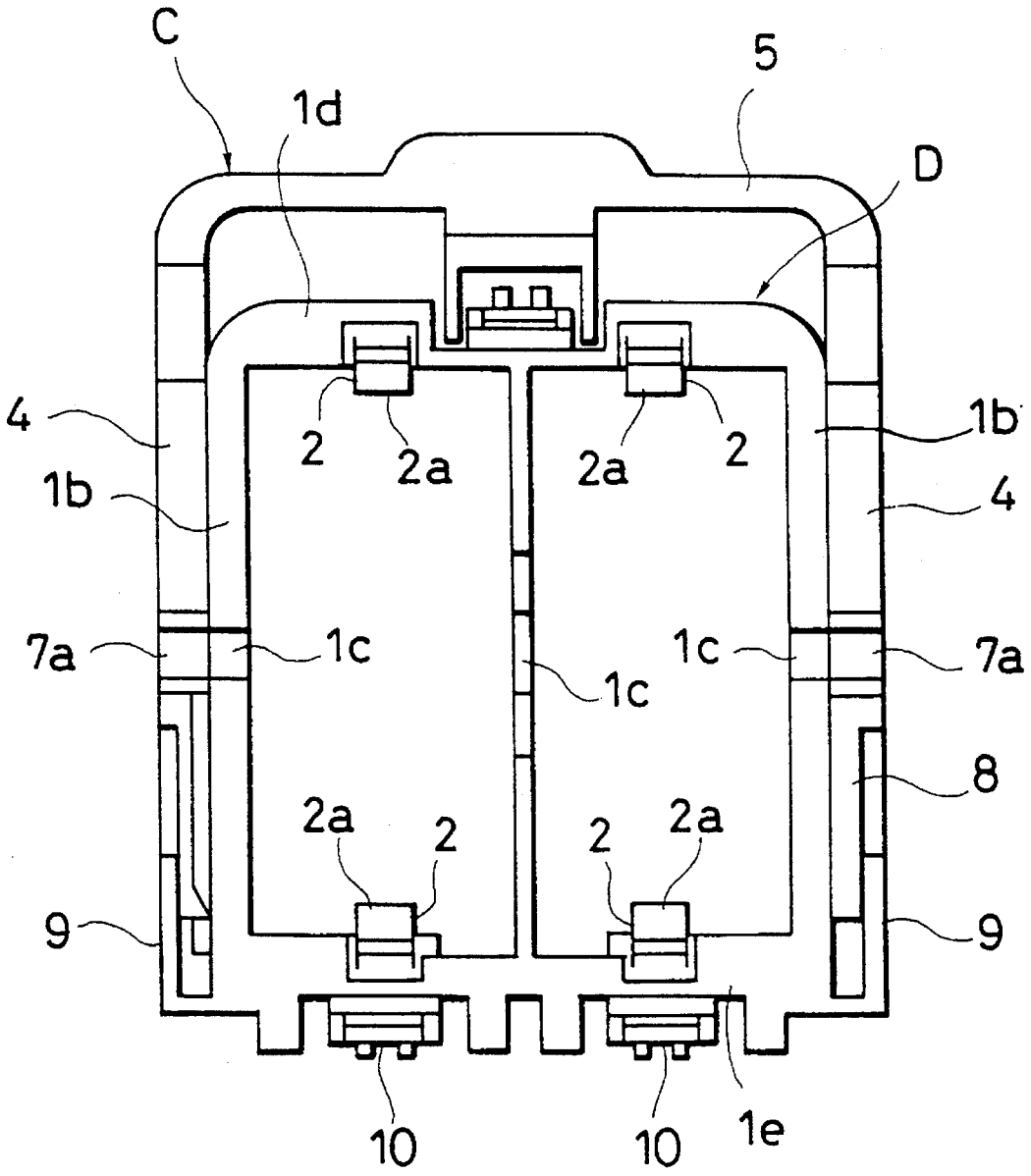
FIG. 2 is a front view of the connector-accommodating frame wit a connecting operation lever according to the present invention.

FIG. 1 shows an embodiment of a connector system requiring a small force by use of an operation lever according to the present invention.

The connector system comprises a pair of male connecters $A_1$ and $A_2$, a pair of female connectors $B_1$ and $B_2$, and a frame D including a connecting operation lever C. The frame D is used for accommodating both female connectors $B_1$ and $B_2$ and includes a flexible synthetic resin-formed housing 1 composed of longitudinal (connecting direction) side walls 1*b*, 1*b*, top walls 1*d* and bottom walls 1*e*. An intermediate wall 1*a* is provided for the housing 1 between the side walls 1*b*, 1*b* so that two chambers $R_1$ and $R_2$ are partitioned no extend from a front end to a rear end of the lever C. A longitudinally-extending guide notch 1*c* is formed on each of the intermediate wall 1*a* and the flexible side walls 1*b*, 1*b*. In each of the chambers $R_1$ and $R_2$, cantilever flexible stopper strips 2 having stoppers 2*a* at the free end are integrally mounted on the inner surface of the top wall 1*d* and the bottom wall 1*e*. A pivot 3 is arranged on the outer surface at the rear of each of the guide notches 1*c* provided for the side walls 1*b*, 1*b*.

The connecting operation lever C is formed in a sectional U-shape in which shoulders of a pair of drive plates 4, 4 opposedly facing to each other are connected by an operation member 5. Each of the drive plates 4, 4 has a pivot hole 6 and a drive cam groove 7 including an open end 7*a* on one side. The pivot hole 6 of the drive plate 4 is engaged with the pivot 3 of the housing 1, thereby mounting the lever C pivotally on the frame D for accommodating the connector. A thin plate-like engaging portion 8 arranged on a free end of a non-connecting portion of the lever C is slidably arranged within each of separation-preventing plates 9 disposed at the bottom of the side walls 1*b*, 1*b* of the housing 1. A cantilever flexible stopper strip 10 engaged with a bracket (not shown) is arranged outside each of the bottom walls 1*e* of the connector-accommodating frame D.

The pair of female connectors $B_1$ and $B_2$ are first inserted into the chambers $R_1$ and $R_2$ of the connector-accommodating frame D in such a way that stoppers 11 are engaged with the rear end of the frame D. In such a case, the stoppers 2*a* of the flexible stopper strips 2 arranged inside the top and bottom walls 1*d* and 1*e* are engaged with steps 12 of the female connectors $B_1$ and $B_2$, thereby fixing the female connectors $B_1$ and $B_2$ within the frame D (See FIG. 3).

Figure 3:
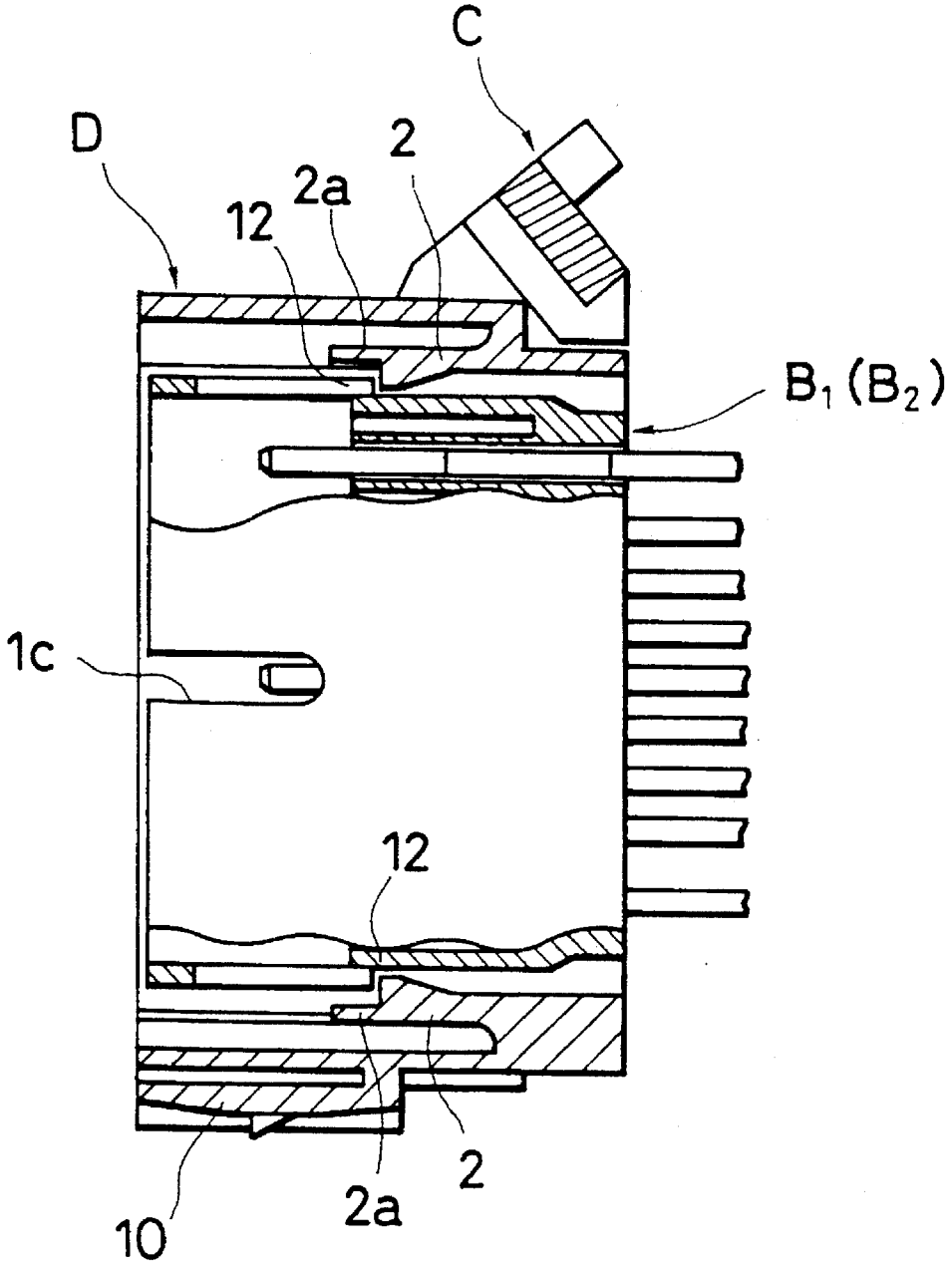
FIG. 3 a partially cutaway view of the connector-accommodating frame having a female connector accommodated therein.
Figure 4:
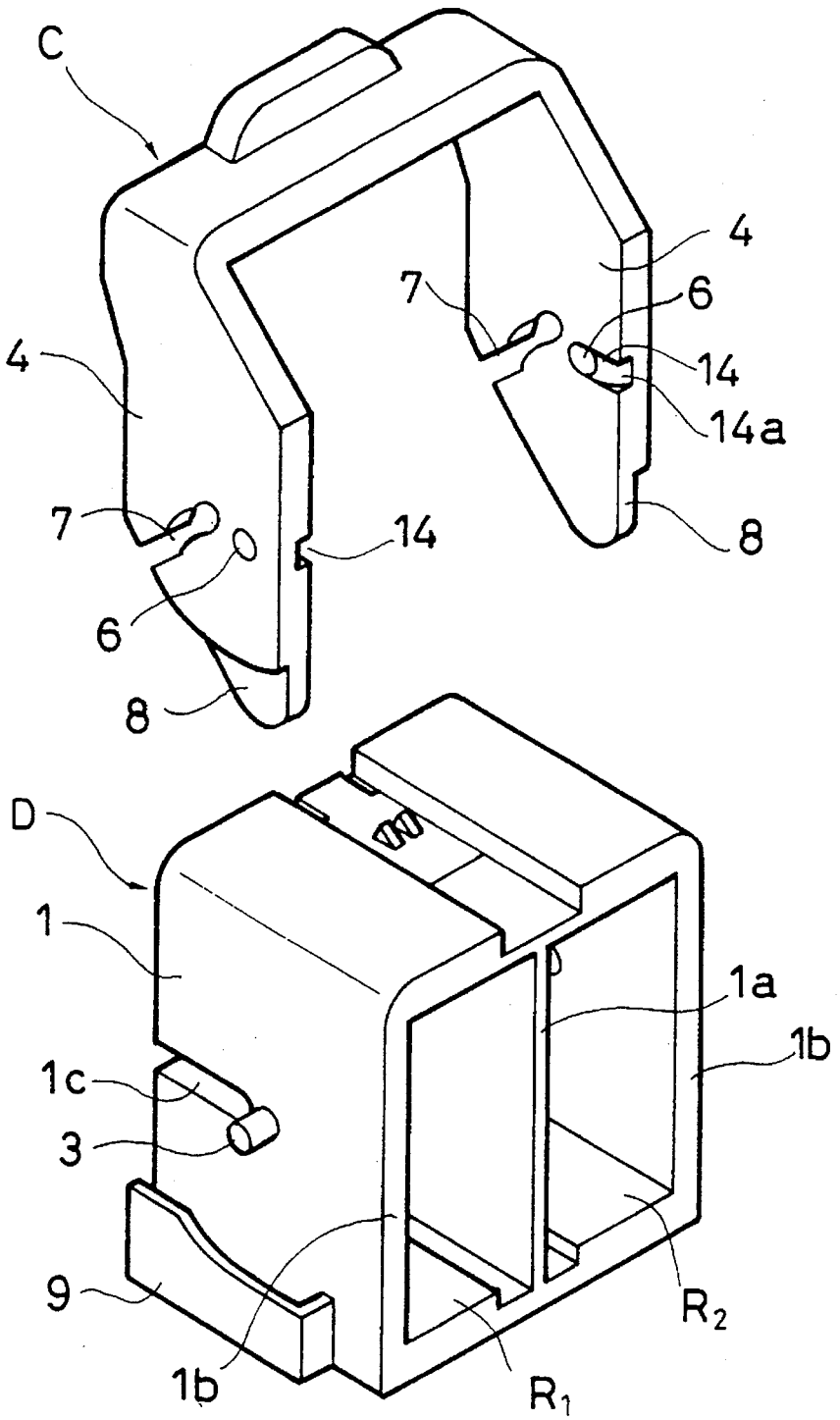
FIG. 4 is an exploded perspective view of the connecting operation lever and the connector-accommodating frame.

In the state of the female connectors $B_1$ and $B_2$ accommodated within the frame D shown in FIG. 3, the male connector $A_1$ and $A_2$ are connected to the female connector $B_1$ and $B_2$ by the following process. Driven pins 13 provided for the side walls of the male connectors $A_1$ and $A_2$ advance into the guide notches 1*c* and 1*c'* of the connector-accommodating frame D and the female connectors $B_1$ and $B_2$, respectively, and also into the open ends 7*a* of the drive cam grooves 7 on the drive plates 4 of the lever C. The lever C is then pivoted, thereby fitting the male connectors $A_1$ and $A_2$ into the drive cams 7 via the pins 13.

Connection guide grooves 14 having pivot-introducing tapered portions 14*a* extending from the rear end of the drive plates 4 toward the pivot holes 6 are formed inside the drive plates 4 of the lever C.

Figure 5:
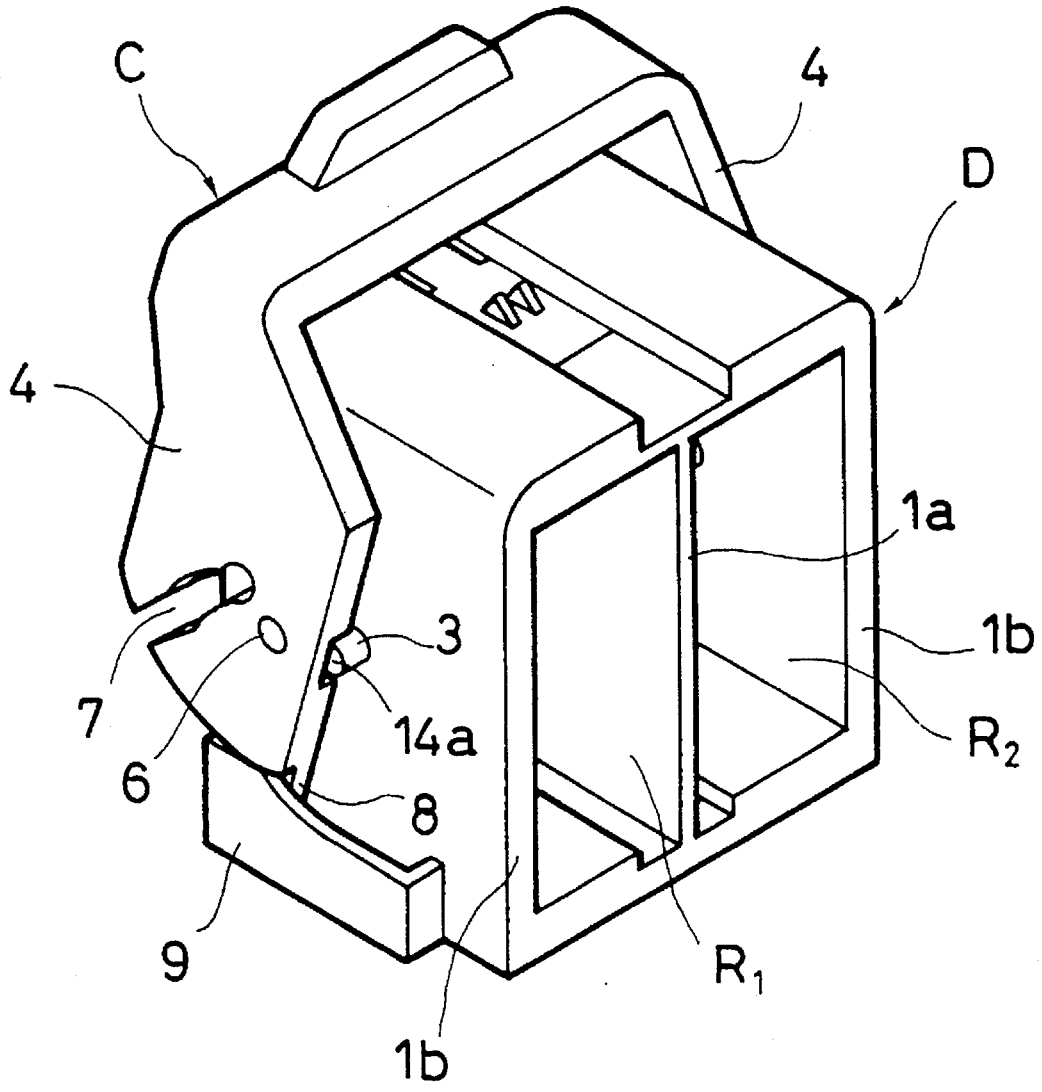
FIG. 5 is a perspective view of the connecting operation lever being fit on the frame.

According to the construction as described above, the connecting operation lever C is connected to the connector-accommodating frame D as follows. While from the forward side of the frame D, the engaging portions 8, 8 disposed at the free ends of the drive plates 4, 4 are engaged within the separation-preventing plates 9, 9 disposed outside the side walls 1*b*, 1*b*, the pivot-introducing tapered portions 14*a*, 14*a* abut against the pivots 3, 3 (See FIG. 5). In this state, the drive plates 4, 4 are pressurized backward so as to allow the side walls 1*b*, 1*b* of the frame D to be flexibly deformed inside as indicated by imaginary lines in FIG. 5 and also allow the pivots 3, 3 to be guided into the pivot holes 6, 6 via the guide grooves 14, 14. The pivots 3, 3 are thus fit into the pivot holes 6, 6, thereby restoring the side walls 1*b*, 1*b* into the original state.

According to the foregoing description, the present invention offers the following advantages.

The connecting operation lever can be reliably and easily fit on the connector-accommodating frame so that they can be prevented from being separated from each other. Also, the connection of the lever and the frame can be secured once they are connected to each other.

The invention is claimed is:

1. A connector system requiring a small force by use of an operation lever, said system comprising:

first connector means and second connector means for connecting to each other;

a frame surrounding and being slidably mountable on said second connector means before connecting said first and second connector means, said frame including a pair of flexible side walls and a bottom wall, a pivot being provided on an outer surface of each side wall, and a separation preventing plate integrally formed with said bottom wall and outwardly extending from said each side wall;

pivotable lever means disposed on said frame to connect said first and second connector means within said frame, said lever means including a pair of drive plates, each drive plate having a pivot hole engaging with said pivot, a free end portion for engaging with said separation preventing plate, and connection guide means for guiding said pivot into said pivot hole, said connection guide means being formed of an introducing tapered portion disposed on an inner surface of said drive plate for engaging with said pivot at the same time as engagement of said separation preventing plate and said free end portion of said drive plate and a connection guide groove continuously connected to said introducing tapered portion for guiding and engaging with said pivot upon pressurizing said drive plates and causing inwardly deforming of said side walls of said frame.

2. A connector system according to claim 1, wherein said free end portion of said pivotable lever means includes a thin plate-like engaging portion slidable within said separation preventing plate.

* * * * *